US009296403B2

(12) United States Patent
Padulosi et al.

(10) Patent No.: US 9,296,403 B2
(45) Date of Patent: Mar. 29, 2016

(54) APPARATUS AND CORRESPONDING METHOD FOR THE AUTOMATIC IDENTIFICATION OF ENTITIES MOVED TOGETHER

(71) Applicant: EUROTECH SPA, Amaro (IT)

(72) Inventors: Ugo Padulosi, Martignacco (IT); Stefano Adami, Volano (IT)

(73) Assignee: EUROTECH SPA, Amaro (IT)

( * ) Notice: Subject to any disclaimer, the term of this patent is extended or adjusted under 35 U.S.C. 154(b) by 0 days.

(21) Appl. No.: 14/406,000

(22) PCT Filed: Jun. 6, 2013

(86) PCT No.: PCT/IB2013/001175

§ 371 (c)(1),
(2) Date: Dec. 5, 2014

(87) PCT Pub. No.: WO2013/182887

PCT Pub. Date: Dec. 12, 2013

(65) Prior Publication Data

US 2015/0148984 A1 May 28, 2015

(30) Foreign Application Priority Data

Jun. 6, 2012 (IT) ..... UD2012A0105

(51) Int. Cl.
*G05D 1/00* (2006.01)
*B61L 25/04* (2006.01)
(Continued)

(52) U.S. Cl.
CPC ..... *B61L 25/04* (2013.01); *B61L 25/028* (2013.01); *B61L 25/043* (2013.01); *B61L 25/046* (2013.01); *B61L 15/0027* (2013.01)

(58) Field of Classification Search
CPC ..... B61L 25/04; B61L 25/028; B61L 25/043; B61L 25/046; B61L 15/0027
USPC ..... 701/1, 19, 36; 246/122 R, 167 R
See application file for complete search history.

(56) References Cited

U.S. PATENT DOCUMENTS 4,689,602 A * 8/1987 Morihara et al. ..... 340/438
4,825,189 A * 4/1989 Honma et al. ..... 246/166.1
(Continued)

FOREIGN PATENT DOCUMENTS

DE 19723309 A1 12/1998
DE 102007040165 * 2/2009
(Continued)

OTHER PUBLICATIONS

International Search Report and Written Opinion dated Jan. 30, 2014 issued on PCT Patent Application No. PCT/IB2013/001175 dated Jun. 6, 2013, European Patent Office.

*Primary Examiner* — Gertrude Arthur Jeanglaude
(74) *Attorney, Agent, or Firm* — Mannava & Kang, P.C.

(57) ABSTRACT

Apparatus for the automatic identification of entities moved together by a transport vehicle comprising a first element, constrained to the transport vehicle which moves the entities together, and configured to acquire in digital form a trend within a first time interval of the acceleration, or first acceleration profile, to which the transport vehicle is subjected. A second element is constrained to each of the entities in motion, and configured to acquire in digital form a trend within a second time interval of the acceleration, or second acceleration profile, to which the entity is subjected. A wireless radio network may be used for the communication between the first element, and each second element.

18 Claims, 6 Drawing Sheets

(51) Int. Cl.
*B61L 25/02* (2006.01)
*B61L 15/00* (2006.01)

(56) References Cited

U.S. PATENT DOCUMENTS 5,651,517 A * 7/1997 Stevens et al. ..... 246/2 R
5,777,547 A * 7/1998 Waldrop ..... 340/438
5,986,579 A * 11/1999 Halvorson ..... 340/933
6,114,974 A 9/2000 Halvorson
2008/0269957 A1 10/2008 Rooney et al.

FOREIGN PATENT DOCUMENTS

DE 102007040165 A1 2/2009
DE 102009016763 A1 10/2010
EP 1031488 A1 8/2000
EP 1406207 A1 4/2004
WO WO 01/49546 A1 7/2001

* cited by examiner

APPARATUS AND CORRESPONDING METHOD FOR THE AUTOMATIC IDENTIFICATION OF ENTITIES MOVED TOGETHER

CLAIM FOR PRIORITY

The present application is a national stage filing under 35 U.S.C 371 of PCT application number PCT/IB2013/001175, having an international filing date of Jun. 6, 2013, which claims priority to Italian application number UD2012A000105, having a filing date of Jun. 6, 2012, the disclosures of which are hereby incorporated by reference in their entireties.

FIELD OF THE INVENTION

The present invention concerns an apparatus and corresponding method for the automatic identification of entities moved together by a motor unit, that is, entities temporarily in substantially integrated motion with each other, and which therefore demonstrate a mechanical behavior that is similar to a behavior due to a rigid constraint between the entities in movement.

BACKGROUND OF THE INVENTION

In the railway field, it is known to apply various apparatuses to identify wagons belonging to a convoy moved by a motor unit, some of which provide a connection by a cabled network between the wagons, while others provide to transmit an identification of the wagons.

For example, U.S. Pat. No. 6,114,974, EP-A-1.0314.88 and U.S. Pat. No. 5,651,517 use a reading of a gradient of a physical quantity along the train to identify the composition thereof, and require a cabled connection.

Another apparatus is known, based on GPS localization, in which the localization information of a wagon are sent on a cell network to the central unit for comparison between the localization information and the railway network.

Again in this field, document WO-A-01/49546 is known, which teaches an apparatus and a method based on the processing of the GPS signal to determine the order and orientation of locomotives moved together in railway stations or yards.

These systems are effective if the vehicles to be traced remain stationary for a long time, or in any case when the response times required of the identification and/or serialization system are in the order of at least some minutes.

Otherwise, these systems cannot be used in practice to identify entities moved together, mainly because of the limitations of use imposed by the reception of a GPS signal:

localization error in some cases comparable with the size of the vehicle analyzed;

possible unavailability of the GPS information when required;

latency times of the localization information typically varying from a few seconds to a few minutes, depending on the last fix, the state of the satellites and other, hence comparable with the overall expected identification times;

cost and additional complexity of the solution for each vehicle to be identified, also with regard to installation and maintenance.

In order to try and overcome some of the limitations described above, document DE-A-102007040165 uses a temporal reference supplied by the GPS receiver installed on every vehicle together with a local timer to memorize the timetables or timestamps in which the vehicle is subjected to an acceleration event, and to make deductions on the composition of the convoy by comparing the sequence of temporal events recorded by the motor unit with the one received by each vehicle in the vicinity that can be reached by the radio transceiver installed on the motor unit. This comparison allows to identify the starting states of the individual vehicle. The method described in DE-A-102007040165 remains subject to the intrinsic limitations of GPS technology, in particular the unavailability of an adequately precise temporal reference in correspondence with the acceleration event to be memorized, in all conditions of accelerated motion, not only at start-off. Furthermore, the method is not suitable when the entities moved together are constrained differently to the tractor vehicle, for example a wagon and a transported baggage, since the stress detected from the two entities may have a considerably different trend and entity, and may not be correctly detected by the same sensor. Moreover the method is weak in particular but not improbable conditions such as the simultaneous departure of two or more adjacent trains in a railway yard. In order to compensate this intrinsic weakness of the identification method it is provided to use other kinematic quantities, such as speed, distance traveled, direction of motion or geo-localization of the vehicle which typically, however, are deduced from the GPS signal when available. Finally the method proposed in DE-A-102007040165 does not allow to make deductions on the nature of the entities moved together.

To identify carriages during or after the convoy has been made up, current systems use electronic devices that dialog with a supervisor device using cable connections installed in the carriages and along the whole convoy, or by means of wireless networks. However, to prevent a device from dialoging erroneously with the supervisor of another train that is under radio cover, wireless networks generally need specific configurations with every movement of a carriage, which is very disadvantageous and burdensome for the management of the convoy.

In particular, document US-A-2008269957 is known, which provides a system to determine the order of the wagons once it is known which wagons belong to the train, also called serialization procedure. The system is based on the detection of environmental quantities to which the mean in motion is subjected, with the corresponding sending of an announcement message on the communication network. In this known solution, each carriage must be identified in advance with a univocal carriage identification. Furthermore, this known system requires a personalized wireless communication method between the various devices of the carriages, in which there is a communication on a first frequency, known in advance in the station, and a communication on a second frequency known in advance, different from the first frequency, when in motion.

Further apparatuses are known, costly and complex to maintain, which comprise "radar columns" positioned near the station, to discriminate the localization of one wagon with respect to an adjacent one.

Apparatuses are also known that provide passages where an RFID tag is read, at exit from the station, which record the RFID codes of the carriages of a train in transit. This known solution also requires a costly infrastructure which impacts with the structure of current stations.

A solution is also known that is based on viewing systems, in which a TV camera at exit from the station acquires the images of the sides of all the carriages in transit and in particular interprets a graphical ID applied. In this case too, it is an infrastructure that is complex to manage and maintain.

Another solution is also known, based on wireless TAGs, but these are not robust in the case of trains near to stations or adjacent in motion at almost constant speed, and require manual configurations.

It is also known that it is necessary to enable several devices for communication and access to information services so that they can communicate with each other and/or with a supervisor device in wireless mode. Access to such wireless networks is regulated by security keys consisting of sequences of bits, and the devices can dialog with each other or with a possible supervisor if they possess said keys. At present no limit to association and access to a determinate network is given to the devices as a consequence of being transported or not being transported by the same vehicle, or moved together. Therefore, devices which, as a pre-requisite, are in radio visibility, which use the same protocols and which possess the appropriate security keys can dialog with the same supervisor or among themselves even if they are transported by different vehicles from that of the supervisor. This is the case, for example, of devices that are on different trains, but at distances such as to be all under the same radio cover.

However, there are situations in which the knowledge of the access key for a particular radio network by a device is made difficult or impossible by the movement of the device, its location on the mean that implies a bad or difficult radio cover, or a logistic of use, which can require connection to a radio network for example of a train on which the device is transported, without there being any possibility of informing the device about which the access key to said network of that particular train is. Furthermore, a device may request to be connected to another device of the same train without either of the two knowing in advance the access key to the data radio network.

One purpose of the present invention is to obtain an apparatus and a corresponding method that overcome the limits of the state of the art, allowing to identify correctly and effectively entities moving together, that is, to identify that said entities belong to a determinate convoy in movement.

Another purpose is to identify said entities in movement together during or after the convoy has been put together by means of wireless network and without needing specific configurations.

Another purpose is the automatic identification of only those entities moving in an integrated motion, without using cabled networks or when there is even a temporary lack of reception of the GPS geo-localization signal or other form of connectivity with a remote central control unit.

Another purpose is to automatically enable access of the entities to communication and information services of a convoy of only the radio network of the transport vehicle.

Finally, another purpose is to discriminate the nature of the entities moved together, for example in the case of railways, between carriages and baggage transported or mobile electronic devices carried by passengers.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, Applicant has developed an apparatus and a method for the automatic identification of entities moved together by a transport vehicle, which provides to acquire in digital form the trend within a certain time interval of the acceleration, or acceleration profile, to which at least one of said entities is subjected, and to verify if any entity present in the vicinity corresponds to one of the entities currently being moved by said transport vehicle, comparing the acceleration profile of the transport vehicle with one or more other second acceleration profiles, to identify in the movement of the entities an accelerated motion similar to that of the transport vehicle, and to automatically identify the entities subject to said accelerated movement, discriminating from other entities present in the vicinity, either in motion or not.

The apparatus according to the present invention comprises at least a first element, or electronic supervisor device, constrained to the transport vehicle that moves a certain group of said entities and configured to acquire in digital form the trend within a first time interval of the acceleration, or first acceleration profile, to which said transport vehicle is subjected.

The apparatus according to the present invention also comprises at least a second element, or electronic local device, constrained to at least one of said entities in motion, which allows to acquire in digital form the trend within a second time interval of the acceleration, or second acceleration profile, to which said moving entity is subjected.

The first element, or electronic supervisor device, is also configured:

to detect, by means of the electronic unit, or accelerometer, at least a significant acceleration event to which the entities moved and/or the transport vehicle are subjected locally, wherein the starting moment of the first time interval and the starting moment of the second time interval correspond to the start of said significant acceleration event;

to effect, by means of the electronic control unit, an operation of crossed correlation of the first acceleration profile and the second acceleration profile to verify whether any entity present in the vicinity corresponds to one of those currently moved by it.

In some forms of embodiment, the crossed correlation operation provides:

to compare the first acceleration profile with one or more other second acceleration profiles;

if, in the comparison, a part is identified of the first time interval and the second time interval in which the first acceleration profile and the second acceleration profile are more similar, to automatically identify the corresponding entities as moved by said transport vehicle, discriminating from other entities present in the vicinity, whether moving or not. Based on the specific application context it is also possible to univocally identify the entities from each other.

According to the present invention, it is provided to use a non-cabled communication, that is, wireless, between the elements of the apparatus.

In this way, the present invention makes available an automatic apparatus and method for the univocal digital identification of only those entities temporarily in motion together with a certain transport vehicle, without constraining said entities to be physically connected to the same communication channel.

Consequently, the present invention, based on the detection of the acceleration profile, does not need to assign an obligatory univocal identification to the entities moved.

Furthermore, since the invention detects the similarity between the temporal trend of the acceleration imparted by the transport vehicle, or motor unit, with the trend detected on any entity whatsoever of the convoy, in this way no constraint of configuration is put on the wireless communication network.

Moreover, the present invention is advantageous in that the acceleration profile is sent once only for each identification procedure and not continuously or repeatedly.

By way of example, and without restriction on the field of protection of the present invention, identifying that a given entity belongs to the entities or means actually moved allows the transport vehicle or control vehicle of the convoy to perform the following operations:

to monitor the presence of a transported entity;

to verify that a transported entity is permitted to be actually moved by a determinate vehicle;

to verify that access is enabled to the convoy's available services.

In particular, with reference to the case of the railways, the present invention allows to automatically identify when two or more railway carriages are in movement with the same train, without having recourse to cabled solutions. This information is used to authorize access to the services supplied by the train, and in particular to the data communication network via radio available in the carriages, allowing the connected devices to communicate with each other and possibly with the supervision apparatus of the train.

One example application of the present invention in the railways is to identify the carriages when or after the convoy is made up.

For this applicational context it is possible to univocally identify each wagon of the current composition of the moving train. Furthermore, with the present invention, it is possible to localize the position of one carriage with respect to the others, and therefore in general to define the order of the carriages in the train.

Moreover, in general the present invention allows to localize in real time on which wagon a determinate object identified by the apparatus can be found.

Generally, railway convoys can be made up and moved by modifying the order and number of carriages depending on the use and destination of the elements of the train.

The present invention can provide a valid alternative, low-cost and safe in functioning, to communicate to a supervisor unit of the train the identifications of the carriages that can be linked together dynamically to make up a convoy. In particular the present invention allows to avoid the operations of configuring the devices and the wireless network.

In this variant application, the invention is associable with a carriage identifier, an electronic unit containing a code, or various information, or which dialogs with a device by radio for example using RFID technology or by cable, or which acquires data from any electronic object able to supply a code. The object is integrated with the railway carriage and the code contained therein identifies the carriage univocally inside the whole rolling stock (univocal ID).

Thanks to the present invention, the movement of the convoy during the making up or departure of the train, or again during a suitable acceleration step, allows a supervisor device to identify the local devices that are installed on the carriages, and including also those that are able to transmit, on the radio network for which the supervisor has granted access authorizations, the univocal codes of the carriages, which therefore the supervisor is able to use so as to trace the composition of the train.

Alternatively, if the carriages do not have a univocal identification, it is possible to use the present invention to evaluate the order or serialization of the carriages with respect to a reference carriage, for example the leading one, obtaining the identification of each individual carriage with regard to the current convoy.

As we said, the present invention does not require any manual configuration in order to operate. It is therefore possible to automatically identify any object that moves temporarily on a train, provided that it can be provided with local devices associated with the transport vehicle so as to have, during motion, a significant mechanical behavior for the invention equivalent to the behavior that it would have in the event of a rigid constraint, or similar in suitable hypotheses, between the local devices and the transport vehicle. Therefore, as well as entities statically positioned and integrated with the carriage, such as control devices or devices to monitor the system or the passengers, containers and baggage generally attached to the carriage, it is also possible to identify mobile entities such as bicycles, baggage in general, and other objects not rigidly constrained to the carriage on which it is possible to install the local device according to the invention. In particular it is possible to identify an intelligent electronic device used by a passenger or staff member on board the train, such as the management terminal of the inspectors of baggage/bicycles on board passenger trains, devices for counting passengers/monitoring seats occupied for passenger trains, anti-theft systems for goods trains, for example means of transport such as automobiles transported by goods trains, ticket management terminals, and also smart phones, tablets, navigators, notebooks and suchlike, and consequently to enable access to the connectivity service on the wireless data network available on the train.

Another application of the present invention is automatic wireless identification in all those contexts where mobile elements are present, temporarily connected in sequence, where it can be useful to automatically identify, without human intervention, only those elements in integrated motion. This is obtained, with the present invention, without adding dedicated cabled connections between the connected elements.

It is thus possible to apply the present invention to the carriages of a tram, subway, but also on airport baggage carriers and in sorting goods in the logistics field in general.

Again in the logistics field it is possible to identify a container when it is transported by a mechanical arm or other movement machine for goods, including trucks and 18-wheelers, and to identify parcels simultaneously present on a determinate conveyor belt.

The present invention is also advantageously applied to enable the entities transported for communication and access to information services of the convoy, in particular to enable access of a local device automatically, only to the wireless radio communication network relating to the transport vehicle.

Association to the same wireless radio communication network, for devices moved together, allows them to exchange information with each other concerning the shared movement. This association can also be advantageously dynamic, varying over time depending on the transport of the device by different transport vehicles, for example with the assistance of a GPS geolocalization device.

It is also possible to exploit sensor devices that detect temperature, humidity, pollution or in general environmental characteristics such as light, noise, electromagnetic fields, radioactivity, dust, fumes, or motion characteristics such as speed, accelerations and derivatives thereof, railway jerks and derivatives thereof.

Still other examples of devices that need to be associated dynamically to radio data networks of the vehicles that transport them concern objects that, even if stably connected for example to a wagon, can dynamically change train during the formation of the railway convoy. This is the case of devices that acquire data from railway carriages, such as for example routers or bridges or access points or protocol convertors that connect by radio various sections of data cable lines integrated with the railway carriages so as to constitute a single network that serves the whole convoy, or wagons of the convoys transporting baggage in airports, or objects transported by bus.

Some forms of embodiment of the present invention differ from the state of the art, for example from DE-A-102007040165, at least in that the similarity verification is based on a cross-correlation operation of acceleration signals, analyzed on a finite time window, which can also have a variable duration from wagon to wagon, whose initial moment (time reference) is not memorized but corresponds to the start of the particular stress to which each entity is subjected. This information, which in general is a trend in a significant time interval of three-dimensional acceleration vector, together with the comparison with cross-correlation, guarantees a robust identification system in the various real case histories, with the advantage that it does not need GPS information.

Compared with DE-A-102007040165, the present invention therefore allows a more robust identification in all conditions of accelerated motion, not only at start-off.

In fact, DE-A-102007040165 teaches to record the timestamp of an event, based on a trigger arriving from a vibration sensor, which supplies a threshold of an acceleration value, and not from an accelerometer, which supplies a threshold of an acceleration variation. In this way, DE-A-102007040165 supplies a sequence of timestamps that is characteristic of start-off. The single vibration sensor processes the local kinematic information concerning the acceleration threshold, on the basis of which it triggers the generation of a timestamp and then "filters" the information quantity of the state of motion, that is, the acceleration, locally. In DE-A-102007040165 the comparisons are on the compatibility of the absolute timestamp, after that of the motor unit, but not beyond that of the length of the train, and on the intervals between timestamps, that is, a sequence of consecutive events. Therefore in DE-A-102007040165 an absolute temporal reference is necessary, deriving from a GPS signal when available, since otherwise, because of how the wireless network and the corresponding communication protocol in DE-A-102007040165 are organized, the messages would be received in a non-coordinated manner and, since only temporal offsets are available, without a reference, it would not be possible to derive which acceleration event they refer to.

The match performed by DE-A-102007040165 is therefore restrictive due to the nature of the quantity to be evaluated, that is, the temporal timestamps (which are mono-dimensional scalar quantities). To overcome this, DE-A-102007040165 provides to use other kinematic information, which increases the complexity of the system.

On the contrary, the present invention provides the match considering the kinematic quantity to be analyzed, in general a three-dimensional vector and on a certain time window, precisely to detect a characteristic significant pattern. The present invention does not provide a local filter of the signal acquired, and thus it does not neglect information that could be useful for verifying a match with another remote acceleration profile, since this depends on the specific trend acquired, that is, it is a function of the specific conditions of motion. Advantageously, the algorithm of the match according to the present invention has available the crude information of the kinematic quantity to be compared and therefore it can actuate a series of filters, processing and verifications that allow a robust identification. Consequently, with the present invention the match, performed starting from a high information content, is used with a correlation operation that allows to determine corresponding events in the analysis window and hence to calculate the temporal delays between corresponding events, without needing a common temporal reference.

Furthermore, some forms of embodiment of the present invention allow to classify the entities moved and to identify possible anomalies also in the motion, for example, nosing, thanks to the analysis of the transitory interval antecedent to the similar trend of the accelerations recorded and possibly thanks to the availability of encoded information on the type of entity moved, transmitted to the tractor together with the acceleration event detected.

Furthermore, unlike for example DE-A-102007040165, the present invention allows to adapt the method of acquiring the acceleration signal depending on the state of motion and also the type of entity moved, for example varying the sampling, quantization and activation thresholds, as well as achieving a simpler and cheaper system compared with the state of the art.

The present invention also allows lower response times than in the state of the art, for example under a minute, in the order of some tens of seconds, even in particular situations. For example, the present invention can perform better in the particular situation of adjacent parallel trains that leave together in the same direction from a covered station, where therefore no GPS signal is available. In particular, using the teaching of DE-A-102007040165, in the first minutes after departure it would not be possible to discriminate the carriages of such trains, nor would it be possible to evaluate the distance from the motor unit to each nearby carriage. In fact, the tractor-carriage distance would be valid and compatible, since they are trains on adjacent tracks. In any case, even with a GPS localization, considering the localization error it would be possible to have many carriages compatible with several trains. The timestamps received from the motor units of such convoys would all be compatible with the departure event detected by the motor unit, since the trains left together. Finally, all the trains considered would have the same direction of motion. Consequently, using the system of DE-A-102007040165, in a first step, the duration of which depends on the start-off conditions and the path of the rails, and can even last some minutes, all the carriages will belong to several convoys simultaneously. If the system in DE-A-102007040165 were used for example to grant access to the wireless communication network available to a specific convoy, problems of different types would certainly arise, in particular the problem of secure access. Only in a subsequent step, when the two tracks inevitably begin to distance themselves, if the system in DE-A-102007040165 were able to start another identification step, would the correct identification be obtained, after a few minutes. In the case of the present invention, on the contrary, considering potentially different locomotives on different tracks and different compositions in terms of type of wagon, the analysis of the acceleration curves supplies different levels of cross-correlation which allow to distinguish after a few seconds all the wagons of a convoy compared with the other.

Furthermore, the present invention allows to identify different configurations other than tractor-wagon, and more generally elements moved together, such as elements on a conveyor belt, portable computers on the table of a passenger wagon and suchlike.

BRIEF DESCRIPTION OF THE DRAWINGS

These and other characteristics of the present invention will become apparent from the following description of some forms of embodiment, given as a non-restrictive example with reference to the attached drawings wherein.

To facilitate comprehension, the same reference numbers have been used, where possible, to identify identical common elements in the drawings.

DETAILED DESCRIPTION OF SOME FORMS OF EMBODIMENT

Figure 1B:
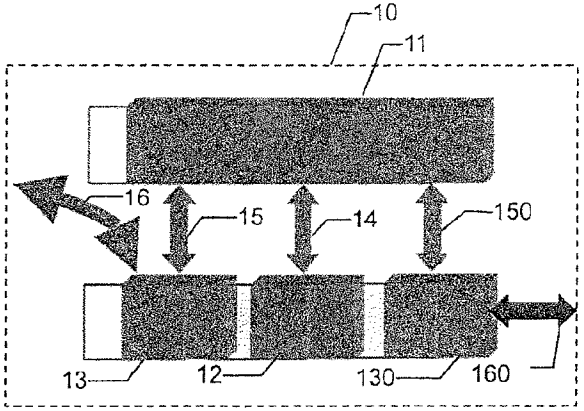
FIG. 1B is a block diagram of a variant of a supervisor device of the present invention.

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Forms of embodiment of the present invention refer in general to a method and corresponding apparatus 100 for the automatic identification of entities moved together by the same transport vehicle, or motor unit.

Forms of embodiment of the present invention provide first elements 17 (FIG. 2A), hereafter called electronic local devices, each associated with the entities moved, and at least a second element, hereafter called electronic supervisor device 10 (FIGS. 1A and 1B) of the transport vehicle, configured to recognize whether, at a certain instant, the local devices 17 are also actually moved by the same vehicle.

The supervisor 10 is solidly connected to the transport vehicle, while the local devices 17 are each attached solidly to a wagon pulled by the transport vehicle or simply transported on the vehicle itself.

The supervisor 10 is configured to enable access of the local devices 17 to a shared wireless radio network 16, for example a WiFi 802.11 type network or a Zigbee or Bluetooth network, and allows for example to associate to the vehicle the information detected by said devices, for example passengers who have got on or off, environmental parameters, codes, deadlines and other.

Figure 6:
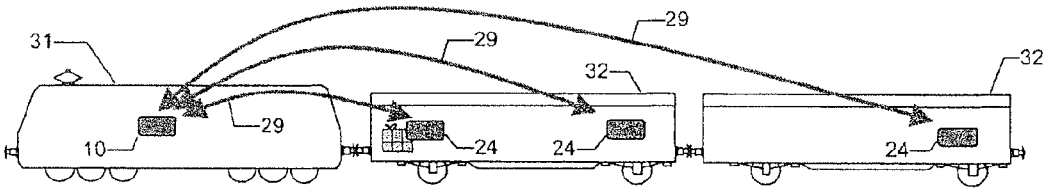
FIG. 6 is a functioning diagram of another possible application of the apparatus and method of the present invention.
Figure 7:
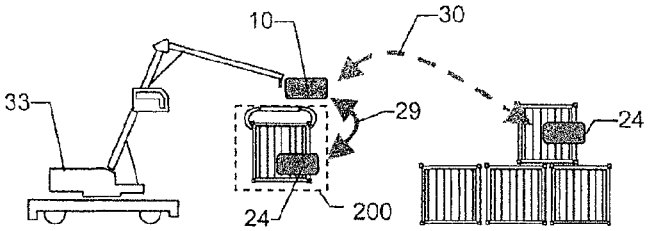
FIG. 7 is a functioning diagram of another possible application of the apparatus and method of the present invention.

The transport vehicle can be directly connected to every entity moved, such as for example a crane, or analogous goods moving machine 33 with a container, a conveyor belt with the entity transported, or indirectly connected by sequences of entities connected to each other, as in the case of a locomotive 31 with a generic wagon 32, such as a goods wagon or passenger carriage, of the convoy (FIGS. 6 and 7).

The supervisor 10 is configured to acquire in digital form the trend within a first time interval of the acceleration, or first acceleration profile, to which the transport vehicle is subjected.

Moreover, the electronic local device 17 is configured to acquire in digital form the trend within a second time interval of the acceleration, or second acceleration profile, to which the moving entity is subjected.

In some forms of embodiment, the supervisor device 10 is also configured:

to detect at least a significant acceleration event to which the entities moved and/or the transport vehicle are locally subjected, wherein both the start of the first time interval and the start of the second time interval correspond to the start of said significant acceleration event;

to effect an operation of crossed correlation of the first acceleration profile and the second acceleration profile to verify whether any entity present in the vicinity corresponds to one of the entities currently moved by said transport vehicle.

In particular, the crossed correlation operation provides:

to compare the first acceleration profile with one or more other second acceleration profiles, for example received from the surrounding environment, including the second acceleration profiles received from each of the electronic local devices 17;

if, in the comparison, a part is identified of the first time interval and the second time interval in which the first acceleration profile and the second acceleration profile are more similar, to automatically identify the corresponding entities as moved by said transport vehicle, discriminating from other entities present in the vicinity, whether moving or not.

In some forms of embodiment, the duration of the first time interval can be different from the duration of the second time interval.

Figure 8:
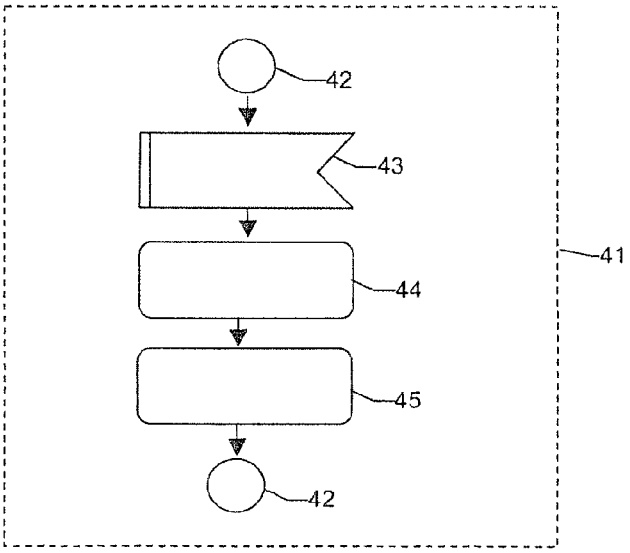
FIG. 8 is a block diagram of a detection of an acceleration profile.
Figure 9:
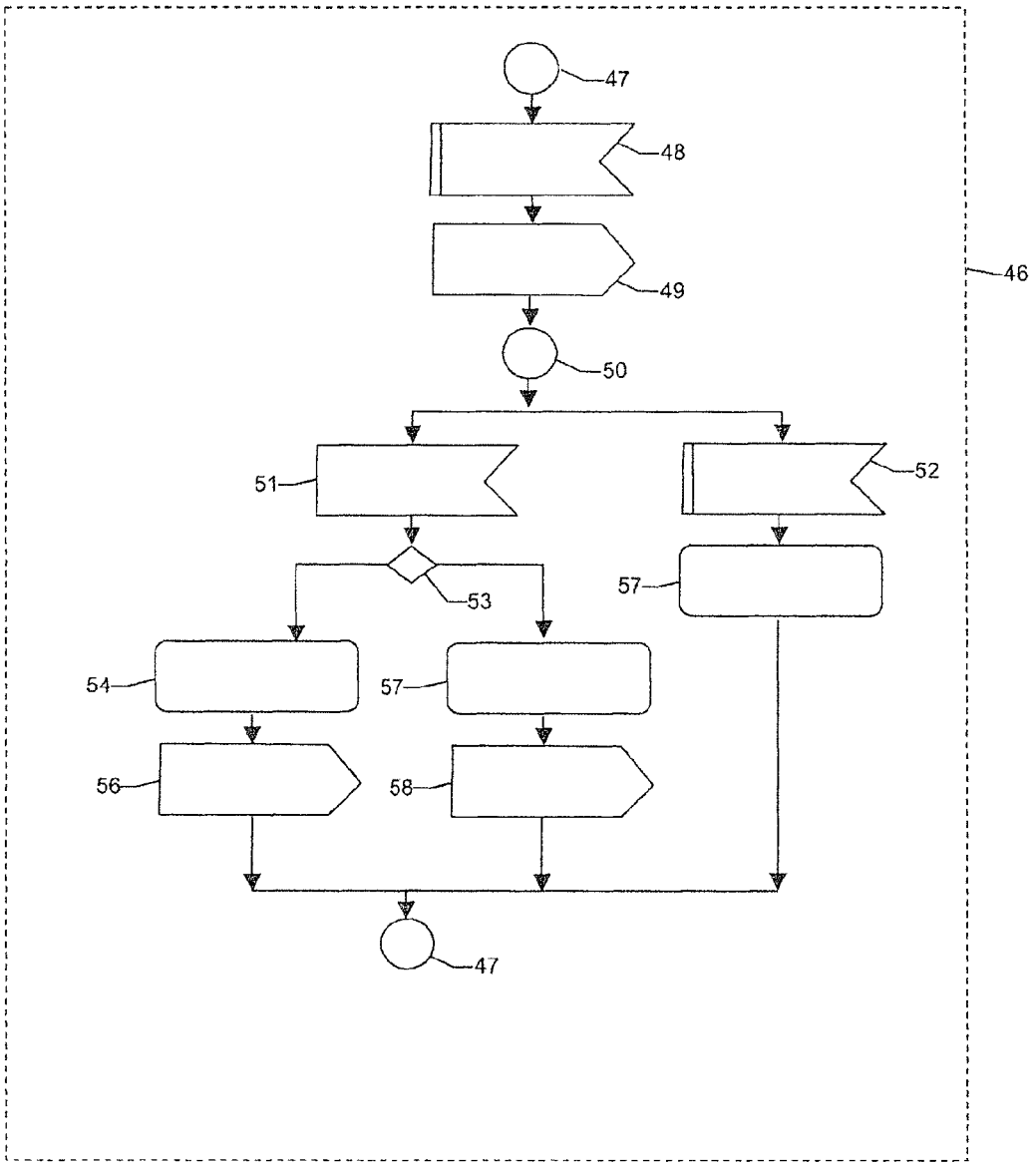
FIG. 9 is a block diagram of a verification of an acceleration profile.

In particular, some forms of embodiment described here provide that the supervisor device 10 is configured to effect an acceleration profile detection procedure 41 (FIG. 8) and a procedure to identify 46 similar acceleration profiles (FIG. 9).

The acceleration profile detection procedure 41 includes a stand-by state 42, awaiting the acceleration sampling start event, a start-of-sampling event 43, a sampling and acquisition 44 of the acceleration by an acceleration measuring unit or accelerometer 12, an updating 45 of the acceleration profile and again a stand-by state 42, awaiting the start-of-sampling of acceleration.

The identification procedure 46 of similar acceleration profiles includes a stand-by state, awaiting a start-of-verification event 47, determined by the supervisor 10 at every predetermined time interval or following an analysis of the acceleration profile of the local devices 17, or of the supervisor 10 itself, in order to identify significant acceleration events for the invention. As discussed above, a subsequent start-of-verification event 48 is then provided, the sending 49 of a radio message to a local device 17 to request a profile, a stand-by state 50 awaiting the profile from the local device 17, which subsequently at output can provide the reception of a radio message 51 that contains the profile from the local device 17, or an error or timeout event 52. The error or timeout event 52 generates the dis-association 57 of the local device 17 from the radio network 16 of the vehicle, and a return to the stand-by state of the start-of-verification event 47. On the contrary, after receiving the radio message 51, a similarity test 53 is provided of the acceleration profiles associated with the supervisor 10 and the local device 17, on the basis of which there is an association 54 of the local device 17 to the radio network 16 of the vehicle if the profiles are similar. After this, a message of association 56 to the radio network 16 of the vehicle is sent to the device, or dis-association 57 of the local device 17 from the radio network 16 of the vehicle, and a message of dis-association 58 from the radio network 16 of the vehicle is sent to the local device 17. Then, in any case, the procedure returns to the stand-by state awaiting the start-of-verification event 47.

Both the supervisor device 10 and each local device 17 consist of an electronic module 80 (FIGS. 1A and 2A) which includes an electronic radio communication unit 13, an electronic control unit 11, in the case of the supervisor 10, and 18 in the case of the local device 17, and an electronic unit or accelerometer 12 to detect the acceleration to which the electronic module 80 is subjected.

Depending on the algorithms and procedures that are implemented in the electronic module 80, the specific functions of the supervisor device 10 or of the local device 17 are obtained. The electronic module 80 is associated with the entity that is to be identified so that the acceleration detected is the acceleration of the entity itself. The electronic module 80 can be fed by the feed supply of the transport vehicle or the moved vehicle, or can have an autonomous feed.

Figure 2B:
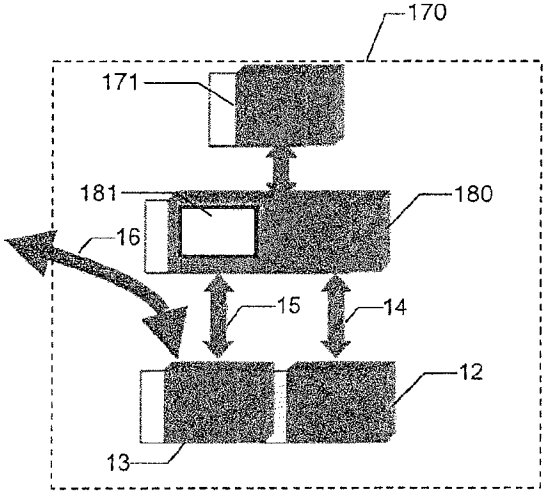
FIG. 2B is a block diagram of an intelligent terminal of the present invention.
Figure 1A:
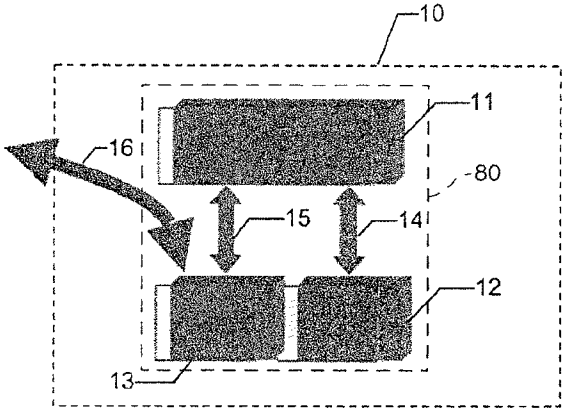
FIG. 1A is a block diagram of a supervisor device of the present invention.
Figure 2A:
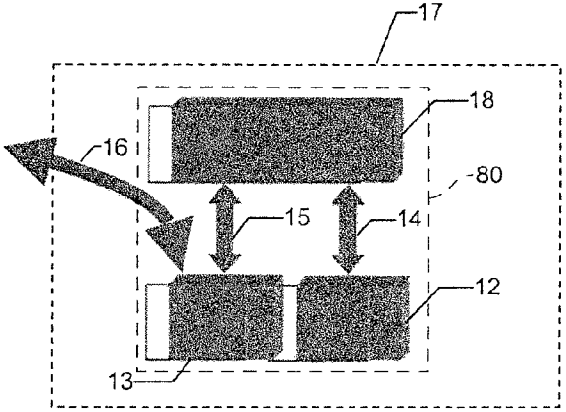
FIG. 2A is a block diagram of a local device of the present invention.

The control unit 11, 18 of each module 80 is configured for:

a transmission/reception 14 of data and/or commands to the accelerometer 12, which can provide, for example, the sending of requests for acceleration values to the accelerometer 12, and the sending of commands to adjust the parameters or precision of the acquisition of the acceleration profiles, and the reception of the acceleration values (FIGS. 1A, 1B, 2A);

a transmission/reception 15 of data and/or commands, such as for example times of sending and methods of acquisition of the acceleration profiles, with the radio network 16 by means of the radio communication unit 13.

The accelerometer 12 of each module 80 generally operates on three orthogonal axes to detect the acceleration in any direction and sense that is applied in space, and supplies an analog or digital code thereof by means of communication lines.

For specific application contexts where the position of all the local devices 17 integrated with the entities moved is controllable and known, it is possible to operate with accelerometers with only 2 orthogonal axes, positioning each local device 17 so as to have one axis of the accelerometer 12 in the direction of movement of the vehicle and the second axis to detect possible lateral accelerations. If said lateral stresses are not interesting or are negligible, it is possible to further reduce the apparatus to a mono-dimensional case, advantageously using accelerometers with one axis.

In the general, three-dimensional case, each sample produced by the accelerometer 12 corresponds to the three-dimensional vector $\bar{a}_i=\{ax_i\cdot\hat{x},ay_i\cdot\hat{y},az_i\cdot\hat{z}\}$ of the acceleration at instant i to which the accelerometers 12 is subjected, and hence the supervisor device 10 or local device 17, with respect to the three detection axes. The spatial orientation of the supervisor 10 can be the same as, or more generally different from, that of a generic local device 17 and the acceleration samples detected, given the same module, can have different values in the individual components.

In a railway application, a local device 17 applied to baggage transported on a carriage will be oriented in a non-predictable manner for the supervisor 10. The same can be said for a local device 17 transported by a passenger on the train. Conversely, the case of a container moved by a crane is more predictable since all the containers can be equipped with a local device 17 orientated with an axis in a vertical direction with respect to the ground and the components of the acceleration vector will be the same, except they can be detected on different axes.

The local control unit 18 of an electronic module 80 that obtains a local device 17 comprises a microcontroller or microprocessor, or other programmable electronic apparatus for carrying out processing, with sufficient capacity at least to acquire data from the accelerometer 12 and to dialog with the radio connection unit 13.

In other cases, the local control unit 18 can be physically integrated into the accelerometer 12, or its functions are obtained by exploiting the processing unit of a more complex device, for example a pre-existing electronic terminal provided with calculation and connection capacities, or an intelligent terminal, such as a smart phone, tablet, navigator, notebook or suchlike, used to execute a specific software that obtains the procedures and processes provided by the invention.

Optionally, the control unit 11 of the supervisor 10 or the control unit 18 of the local device 17 has a memory location (hereafter variable TYPE) and can memorize specific information for each device relating to the type of entity to which it is connected, and selectable from an encoded list of possible values such as for example supervisor, carriage, container, baggage, terminal, generic mobile entity, generic static entity which imply the type of constraint that can be expected between the entity in question and the transport vehicle, as explained in more detail hereafter. This information can be used to optimize the performances of the algorithms according to the invention and to allow evolved processing and controls of the supervisor 10.

The value of the TYPE information can be pre-set during the production of the local device 17 or configured during the installation of the invention, in the step where the local device 17 is associated, also physically, with the entity to be identified, by means for programming the TYPE information by the installer.

The accelerometer 12 is connected to the local control unit 18 to which it supplies the acceleration values to which it is subjected, acquired by the local control unit 18 at intervals such as to adapt to the different applications in which the invention can be used, with a sampling frequency that can vary from a tenth of a hertz to hundreds of kilohertz. It also possibly receives therefrom configuration commands and commands to control the acquisition of the acceleration values.

Advantageously, by means of the accelerometer 12, the control units 11, 18 are configured to automatically detect acceleration events that are significant for the invention and to program the start of a sequence of acquisitions of acceleration samples in order to identify, in the movement of the entities, an accelerated motion similar to that of the transport vehicle, and to cause a start-of-verification event. Significant acceleration events can be selected on the basis of an acceleration threshold (in the module or on the individual components) detected autonomously at regular intervals. Alternatively, the threshold can be set as a gradient of the acceleration detected.

The threshold can be pre-set in the apparatus or is dynamically settable by the electronic module 80 itself, based on the temporal trend of the acceleration or by the control unit 11 of the supervisor device 10, with a suitable command directed to the local devices 17.

The local control unit 18 keeps a circular list of pairs $(\bar{a}_i,\bar{t}_i)$ of values of the last acceleration vectors detected and of the instants of time in which they were measured, which constitutes the "Acceleration Profile", (PA), $\overline{PA}_D(t_0)$ starting from instant $t_0$ of the device D.

The duration of the profile, that is, the number of elements or samples, depends on the transport applications in which the invention is used. For example, in the railway field, in the conditions indicated hereafter, the duration of a significant profile can be from a few seconds to some tens of seconds. The number of samples of the profile is a function of the sampling frequency used for the specific acceleration event to be detected, such as departure or arrival of the train, stress on the bend, acceleration or deceleration while moving, or other.

The acceleration profile characterizes the movement of the devices that belong to the same vehicle, or are moved together. In the event of a constraint between device moved and transport vehicle, which will be discussed in detail hereafter, the accelerations to which said devices are subjected have a similar trend. The invention verifies the similarity between the acceleration profiles of the local devices 17 and the supervisor device 10, to determine whether they belong to the same transport vehicle. The similarity is evaluated considering the level of correlation between the acceleration profiles. In a preferential form of embodiment the function of mutual correlation is used, which makes the verification of similarity more robust.

The local control unit 18 can therefore keep track of the accelerations to which the supervisor device 10 or local device 17 is subjected, with a precision such that no information is lost on the accelerated movement of the vehicle by which the entities are transported. For example, given the typical movement of a train, the characterization of an acceleration in the direction of the track can be adequately profiled by sampling at 20 hertz, in the first seconds of acceleration from stationary, to some tens of a hertz after the first 50 seconds of acceleration. For mobile local devices 17, the sampling can be limited to reduce the energy consumption of the device as much as possible.

In railway applications it may be important to detect other types of significant acceleration events, for example orthogonal to the direction of the tracks, such as jerks, that is, variations in acceleration not compensated on a bend, or events deriving from jolts on the tracks or the exchange mechanisms.

International regulations establish the maximum entity of accelerations or deceleration to which railway material can be subjected: for example the limit for decelerations is 1.0 $m/s^2$ and for jerks is 0.40 $m/s^3$. According to these regulations it is possible to size the use for example of an accelerometer 12 to 10 bit, that is, it converts into a digital signal coded on 10 bit, with a possible range of accelerations detectable from −2 g to +2 g, where g is gravity acceleration, more than sufficient to track the acceleration activities of a train of any range, which are limited, in emergency situations, to 1.4 $m/s^2$. Applications in other fields of transport or movement can require an accelerometer 12 with different characteristics for resolution or for the range of accelerations detectable.

The control unit 11, 18 is also connected to the electronic radio communication unit 13, and can effect the transmission/reception 15 of data to and from the wireless radio network 16; it is also able to obtain the association and access of the control unit 11, 18 to the wireless radio network 16 and communication with any other device connected to the wireless radio network 16 and in particular with any other local device 17 and with the supervisor device 10 according to the invention. By way of example a WiFi 802.11 unit or Zigbee or Bluetooth can be considered.

The wireless radio network 16 of the vehicle is configured to put in communication at least any local device 17, once identified, with the supervisor 10, and is provided with a mechanism for the distribution of information from one or more elements ("broadcasting"), from the supervisor 10 to all the local devices 17 of the wireless radio network 16, or to a subset of the local devices 17, selectable in the broadcasting message itself. For example, the broadcasting mechanism can direct only the devices with a specific value of the variable TYPE (and hence for example only the devices that identify the wagons of a train).

The local devices 17 can for example be selected on the basis of information that they themselves have supplied, like the identification but also the device or constraint that they represent, such as a carriage, baggage or terminal or other. This is to assist the supervisor 10 in its verification activities, for example to make the identification more robust or because the supervisor 10 decides to interrogate only some of the local devices 17, for example the carriages and not the terminals, or again to analyze anomalies.

From the viewpoint of topology, the network can be the mesh type, made according to a single connectivity standard, or mixed both in terms of protocols and of physical level. There may be routers or bridges or access points or protocol convertors that connect by radio various sections of cabled data lines, integrated with the railway carriages or other entities moved together, so as to constitute a single network which serves the whole convoy.

The local control unit 18, by means of the radio communication unit 13, detects the presence in general of a radio network in the field of radio cover of the device. In general it could be the wireless radio network 16 associated with the transport vehicle or relating to a different network, for example statically localized in the vicinity of the device during its travel or relating to another convoy in the vicinity (stationary or moving).

Local Control Device

Each local device 17 consists at least of the electronic module 80 described above, and is configured to obtain at least the acceleration profile detection procedure 41, and also a procedure 59 to request identification and association to the radio network 16.

The identification and association procedure 59 provides an initial stand-by state, awaiting the verification start event 47, a subsequent verification start event 48, the sending to the coordinator-supervisor 10 of a request message 60 for association to the radio network 16, a subsequent stand-by state 61 awaiting the reply message from the coordinator-supervisor 10. Depending on the message, it is provided to have:

reception of a confirmation message 62 for association to the radio network 16 of the vehicle, followed by an association 63 to the radio network 16 of the vehicle;

or reception of a confirmation message of dis-association 64 to the radio network 16 of the vehicle, followed by a dis-association 65 to the radio network 16 of the vehicle;

or error or timeout event 52, followed by the dis-association 57 of the device from the radio network of the vehicle;

then the procedure returns in any case to the stand-by state, awaiting the verification start event 47.

Figure 3:
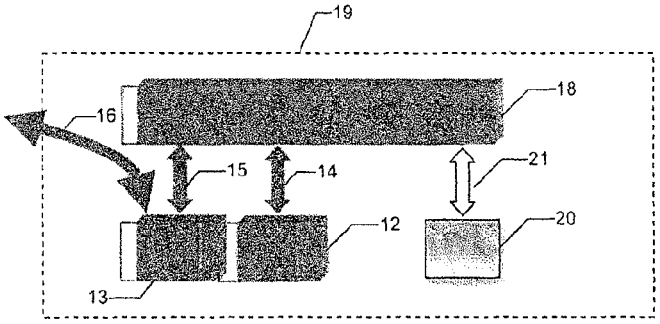
FIG. 3 is a block diagram of a variant of a local device of the present invention.
Figure 5:
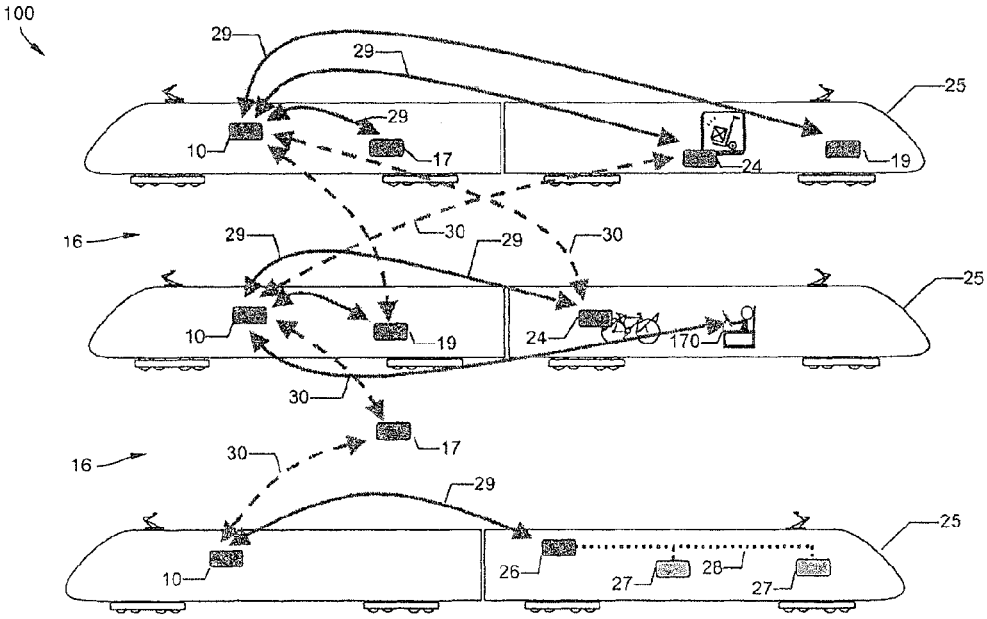
FIG. 5 is a functioning diagram of a possible application of the apparatus and method of the present invention.

Optionally, according to a variant, indicated by the reference number 19 in FIG. 3, the local device can include a data acquisition unit 20 for the reception/transmission of data 21 by a sensor, integrated in the acquisition unit 20 or not, for example to monitor the functioning condition of a carriage of a train 25, and can also acquire data from a network of external sensors connected to the device by cable or by wireless connection, and in this case the local device 19 can integrate an electronic component 26 (FIG. 5) with the function of a router and suitable communication interface to the network of sensors. Sensors 27 may be provided, connected by cable 28 to the electronic component 26.

Figure 4:
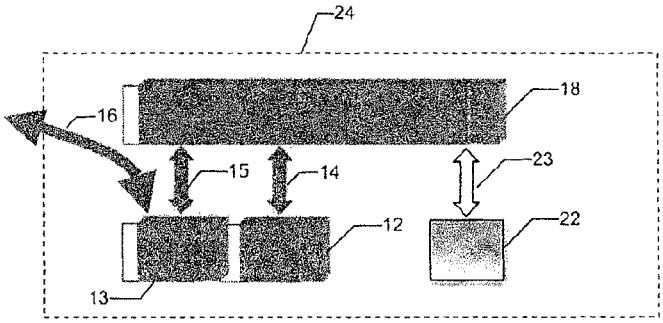
FIG. 4 is a block diagram of another variant of a local device of the present invention.

Optionally, in another variant, indicated by the reference number 24 in FIG. 4, the local device comprises a code acquisition unit 22, in which the memory code is integrated, useful for example to univocally identify a carriage in a railway convoy and to obtain the automatic serialization function. Otherwise, if the electronic unit containing the code is outside the local device 24, for example installed integrated on the carriage, the code can be read by cable or advantageously by radio for example with RFID technology. Advantageously this configuration allows to install the local device 24 on a carriage and to identify it when in motion, independently of the RFID code of the carriage.

In general, the local control device 17 and its variants 19, 24 are made as independent electronic devices able to enable the purposes of the invention for any entity in motion temporarily with the transport vehicle.

If said entity makes available the electronic, communication and computational resources compatible with the invention, it is possible to use them to obtain the functions of the local device 17 on the basis of the entity to be identified, advantageously reducing the overall bulk, the costs and often energy consumption too.

This is the case, for example, when the electronic local device is represented by an intelligent terminal 170, such as a smart phone, tablet, navigator, notebook or suchlike, used by a passenger or staff member working on board the train (FIG. 2B), where the local device, including the electronic radio communication unit, electronic control unit and accelerometer, and the corresponding electronic module 80 are obtained using a control unit 180 of the terminal 170, an integrated accelerometer and a wireless connectivity interface, together with the execution of an applicational software 181 made for the specific terminal that obtains the procedures and processes needed, integrating with the operating system of a user interface 171.

In general, depending on the analysis of similarity between the acceleration profiles the local control device 17, 19, 24 and/or the intelligent terminal 170 can be connected to the supervisor 10 of the same train convoy 25 by means of an authorized radio communication path 29 of the radio network 16, while connection may not be authorized by means of the radio communication path 30 between the supervisor 10 of a train convoy 25 and the local control devices 17, 19, 24 and/or the intelligent terminal 170 of another train convoy 25. This applies both to the case of a train convoy 25 with a locomotive 31 and generic wagon 32 (FIGS. 5 and 6), or cranes or analogous goods movement machines 33 (FIG. 7).

The electronic component 26 as described above can also be connected to the corresponding supervisor 10 of the same convoy by means of the authorized radio communication path 29 of the radio network 16.

Constraints Between Devices and Similarity of Profiles

The similarity of the acceleration signal between entities/devices moved by the same vehicle depends on the mechanical coupling characteristics of the accelerometer 12 and the transport vehicle and hence, in practical cases, between the device 10, 17 provided with accelerometer 12 and the vehicle. In the present invention, in fact, the accelerometer 12 is coupled solidly, that is rigidly, to the local device 17 for which it has to be evaluated whether it belongs to the same transport vehicle as the supervisor device 10, also equipped with an accelerometer 12 according to the invention.

Figure 11:
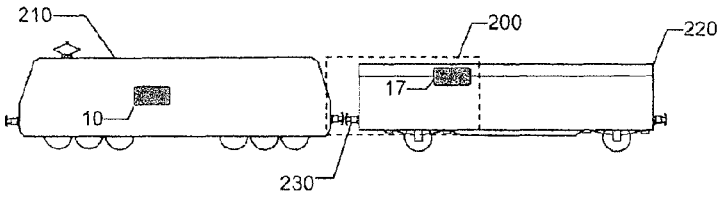
FIG. 11 is a functioning diagram of another possible application of the apparatus and method of the present invention.

In general, the entities moved together with the transport vehicle move with any kind of motion, generally not uniform. It is possible to evaluate the similarity of the acceleration profiles in conditions of accelerated motion. The reference system of the generic device transported is therefore not inertial. In this context it is necessary to introduce hereafter the definitions of "semi-rigid" mechanical coupling and of "constrained device" (FIGS. 11 and 12).

A "constrained device" 200 (FIGS. 7, 11) is a mechanical apparatus formed by a device 220 (FIGS. 11, 12) equipped with accelerometer 12 according to the invention, and by the mechanical constraint 230 (FIG. 11) or 240 (FIG. 12) to the transport vehicle 210. The transport vehicle 210 stresses the assembled system formed by the device plus the constraint and the system responds to the stress with an acceleration, detectable by the accelerometer 12. The shape or temporal evolution of said acceleration depends on the mechanical characteristics of the device and of the constraint, that is, the mechanical characteristics of the "constrained device".

Figure 12:
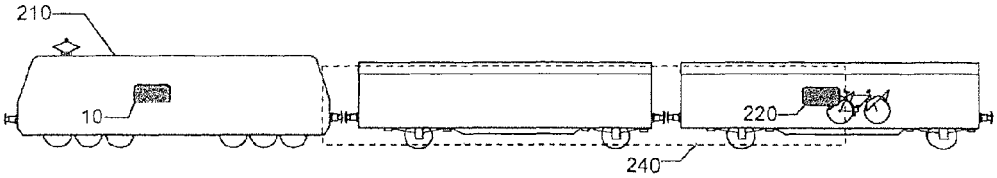
FIG. 12 is a functioning diagram of another possible application of the apparatus and method of the present invention.

For application in the railway field, a case of constraint can consist of the mechanical interface directly joining the motor unit and wagon (coupling device), as shown in FIG. 12 for element 230.

In other cases, between transport vehicle 210 and entity transported there may be a sequence of constraints, more or less complex mechanically, represented in any case by an "equivalent constraint" 240, that is, such that the constrained device is defined by the device/apparatus connected to the equivalent constraint. This is the case of the succession of wagons and hook/coupling that lead from the locomotive to the wagon in question. In the case of a mobile connectivity device in the hands of a passenger sitting on board a railway carriage, the equivalent constraint consists of the body of the passenger and the chain of constraints that lead to the mechanical association with the locomotive (seat, wagons and corresponding hooks). FIG. 12 shows another example of an equivalent constraint between a bicycle and motor unit.

In the description of the present invention we refer to "semi-rigid" constraint when the "constrained device" has characteristics such as to reproduce on the accelerometer 12, after a possible delay of $\Delta t \geq 0$, the stress supplied to the constraint by the vehicle and possibly modifying the characteristics thereof only for those components with frequencies higher than those of interest for the purposes of the invention. The basic case of rigid mechanical constraint between vehicle and device comes into this definition.

In other words, let us consider a vehicle subjected to accelerations of various form (generic stress), the significant characteristics of which, expressed as a function of the spectral components, are contained in frequencies below a certain value, called band B of the acceleration signal (condition valid for any real known apparatus). The vehicle imparts on the devices constrained to it an acceleration whose form depends on the stress imparted by the vehicle itself, and on the mechanical characteristics of the "constrained device", that is, on the mechanical characteristics of the (equivalent) constraint and of the device. If the form of said acceleration (response) differs from the form of the stress acceleration only for frequencies higher than the band of the acceleration signal (stress), we define the constrained system as "semi-rigid".

Within real conditions of measurement with adequate precision and accuracy, a "semi-rigid" constrained system reproduces the same acceleration as the vehicle, that is, it allows the accelerometer 12 to sample an acceleration signal "identical" to the acceleration of the vehicle for all the frequencies below the acceleration band (stress).

The acceleration profile will possibly be delayed temporally with respect to the stress of the vehicle, depending on the mechanical characteristics of the constrained device, as explained in detail hereafter.

Therefore, given a vehicle that stresses the devices constrained to it with a certain acceleration profile, said devices can be, or not, considered as moved with the vehicle, depending on the form of acceleration of the response on the devices. That is, it may be that, for a certain form of acceleration, for example slowly variable, or with a low content of frequencies, the corresponding constraint behaves as semi-rigid whereas, for another form of acceleration, for example rapidly variable, or with a high content of frequencies, the condition of semi-rigid constraint no longer applies.

In particular, the present invention comprises an analysis of the acceleration profile received from the supervisor that provides to identify, for said acceleration profile, two characteristic time intervals in relation to the acceleration profile detected by the supervisor, corresponding in practice to the acceleration imparted by the transport vehicle. A first time interval relates to the period during which the signal received has different characteristics from that detected by the supervisor, corresponding to the so-called "transitory" component of the acceleration profile received. In general, the transitory component can even be absent or negligible with respect to the duration of the whole acceleration profile. Subsequent to the transitory component, the analysis identifies a second time interval, relating to the period when the two acceleration profiles under comparison have a determinate degree of similarity, corresponding to the so-called standard component of the acceleration profile received.

The analysis provides to verify and identify similarity on the standard component of the acceleration profile received.

On the contrary, the transitory component of the acceleration profile is useful for other analyses, such as for example the serialization of the elements or identification of anomalies.

In particular, serialization, that is, the identification of the order of the elements with respect to a sequence, can be carried out by observing the delay in propagating the acceleration profile detected by the supervisor, that is, the delay in mechanical stress along the chain or sequence of entities moved together, in particular by ordering in increasing order the duration of the transitory component of each acceleration profile of the local devices representing each entity moved together.

On the contrary, the presence of anomalies in the motion can be deduced, for example in the case where along the chain or sequence, starting from a certain entity, no similarity as previously detected can be identified any longer in the acceleration profiles.

We shall now discuss in particular the temporal trend of the acceleration profile and how this depends on the mechanical characteristics of the constrained system.

A situation is considered "standard" when the vehicle and all the devices constrained to it semi-rigidly have the same acceleration, for example zero, that is, they are stationary, or moving at constant speed. If the vehicle varies its acceleration up to a certain value, and then keeps it constant, the devices constrained will vary their acceleration and under standard working conditions will tend to assume the same acceleration as the vehicle.

As discussed above, the motion of the devices constrained with a semi-rigid equivalent constraint is therefore represented temporally by a "transitory" period followed by a "standard" period, the first with different accelerations from those imposed by the vehicle, depending on the mechanical characteristics of the constraint, for example elasticity, friction and mass, and of the device, for example mass, the second with accelerations of the devices and of the vehicle that will tend to be the same. For example, in the railway application, for "slow" variations of the acceleration with respect to the mechanical characteristics of the constraint as in the moments after the departure of the train, the trend of the acceleration of the constrained devices is the same as that of the locomotive. In this case, the transitory period is very short, or negligible with respect to the standard acceleration period.

To evaluate similarity between acceleration profiles of the supervisor 10 and a generic local device 17, the invention carries out comparisons, or correlations, between temporal trends at various moments of the motion, looking for similar standard trends. If a similarity is found, it is decided that the vehicle and the local device 17 are temporarily moved together, otherwise the device in question is not moved with the vehicle of the supervisor 10.

The precision with which the similarity between two acceleration trends is evaluated depends on the accuracy of the accelerometer 12, for example more or less 1 bit for each sample detected, in the optimum case.

A variant of the present invention, which also takes into account the accuracy of the accelerometers, uses a mathematical cross-correlation operation, or mutual correlation, to find a measurement that weighs how much the signals are similar, and offers instruments of statistical and numerical analysis adequate for the purpose of the invention. In the case of accelerometers that are not accurate, the invention provides to activate the identification procedure (and hence to verify the similarity of the profiles acquired) preferably in time periods where the acceleration of the vehicle is most variable.

The characteristics of the transitory can instead supply information on the constrained device, in particular on the type of equivalent constraint and device moved. Duration, amplitude, and in general trend of the transitory can be characteristic of types of devices and corresponding constraints, for example worn by passengers or objects transported and "freer" to move.

A "signature", that is, an identification and univocal "pattern" of the transitories which characterizes the device transported, can therefore be acquired with the present invention, and compared with an archive of representative signatures of specific constrained devices, to enable or not the application of procedures, permits, statistics relating to the type of devices transported.

Advantageously, the procedure to verify the similarity of the profiles can compare the TYPE information (relating to the type of device constrained) with the information deduced from the transitory, for example to increase the strength of the identification algorithm of similar profiles or to identify anomalous conditions for example in the motion of the constrained device.

For example, in the railway field, the TYPE information can be sent from the local device 17 to the supervisor 10 in the identification procedure together with the acceleration profile detected. The algorithm to verify similar profiles verifies the correspondence of the standard trend. Furthermore, the presence of an evident transitory with a certain profile is compatible with the TYPE="terminal" information. The procedure therefore identifies the device as belonging to the convoy.

Moreover, it is possible to identify anomalies in movement for devices previously identified, for example anomalous oscillation of a container lifted by cranes for moving goods, or the typical condition known as nosing for a train lacking control systems for that purpose. A carriage subjected to nosing can have an anomalous transitory period and in certain cases does not reach a standard state of acceleration comparable with that of the locomotive.

In trains, or in general in vehicles consisting of a sequence of carriages constrained to each other, the delay with which a device establishes a standard trend with respect to the stress measured by a supervisor device located for example in the first carriage, can identify the position of the devices in the carriages. In fact, the constraint between the carriages inserts a transitory in the movement of the devices that delays the moment when the supervisor will be able to detect a similarity between the trends of the standard accelerations.

Supervisor Device

The supervisor device 10 associated with the transport vehicle comprises at least the electronic module 80 previously described, and obtains at least the procedure to detect the acceleration profile 41. Compared to the local device 17, the supervisor device 10 has the following characteristics and differences:

it achieves the identification procedure 46, that is, it verifies similar acceleration profiles;

it has instantaneous information available on the speed of the convoy;

it can optionally support and/or manage communication between several supervisor devices 10 (FIG. 1B);

it can optionally achieve a procedure to manage the rules of access to the wireless radio communication network 16 between the devices transported (where supported);

it can optionally have available the control information of the vehicle, the means transported or others (depending on the application context).

As we have seen, the acceleration profile $\overline{PA}_D(t_0)$ generally consists of samples of the three-dimensional acceleration vector, referred to the spatial orientation of the local device 17. Furthermore, this orientation is not predefined and in general it is different from that of the supervisor device 10. The correlation algorithm between two generic profiles acquired starting from the instant of time $t_0$, $\overline{PA}_{DL}(t_0)$ and $\overline{PA}_S(t_0)$, respectively of a local device 17 and a supervisor device 10, is able to obtain vector processings to verify similarity for two vectors generically oriented in space, for example comparing the modulus of the acceleration vector and possibly to operate a rotation of the reference system so as to minimize the mean quadratic deviation of the components.

In other forms of embodiment, the supervisor 10 can be configured to detect directly only the event to which the transport vehicle is subjected, and not the events to which the other entities in movement are subjected, receiving only the stress to which said other entities are subjected. In these cases, the accelerometer 12 which can be used is not the one connected directly to the electronic control unit 11 of the supervisor 10, but is associated to the control unit 18, 180 of the local device 17, 170.

In other forms of embodiment, the local control unit 18 transmits to the supervisor 10 of the vehicle on the wireless radio network 16 its own acceleration profile $\overline{PA}_D(t_0)$, as a request to be possibly recognized as moved by the same transport vehicle, and therefore to be enabled to use the radio resources or to associate its own data to the vehicle. The supervisor 10 compares the acceleration profile received with its own acceleration profile and the verification of a sufficient level of similarity between the two profiles allows the supervisor 10 to recognize the requesting device as moved, or not, by the same transport vehicle.

If affirmative, with different methods depending on the radio networks 16, the supervisor 10 can enable the requesting device to access protected functions of the network or to establish with it a data exchange session or other applicational dialog modes which may or may not require the use of security keys. The supervisor 10 can inform the device that it has recognized it as present on the same vehicle.

The supervisor 10 keeps updated a list of the devices identified as transported by the vehicle and periodically, at the most appropriate times, verifies the acceleration profiles so as to update the possible abandonment of the vehicle by the device, or to serialize the convoy so as to order the carriages that make it up, or again for safety reasons. The supervisor 10 starts the verification procedure of the profiles 46 by sending a radio message 49 requesting a profile, broadcast to all the local devices 17 that can be reached, previously identified and/or not identified, depending on the application.

In variant forms of embodiment, it is possible to effect on each local device 17, 170 a comparison analysis of the acceleration profiles to identify correspondences, instead of only by the supervisor 10 associated with the transport vehicle.

In other words, as an alternative to the solution where the supervisor 10 compares the first acceleration profile and other acceleration profiles received from the surrounding environment, also including the second profiles of the entities moved by the transport vehicle, it may be provided that the comparison is carried out by a local device 17 that compares locally its own second acceleration profile with the first acceleration profile of the transport vehicle present in the vicinity.

For example, in some cases the supervisor 10 can send on the wireless radio network 16 its own acceleration profile, and only the devices that recognize that profile as similar to their own can confirm to the supervisor 10 that they belong to the same transport vehicle. This alternative allows to reduce radio traffic by devices requesting to be associated to the radio networks 16 of the vehicles.

Figure 10:
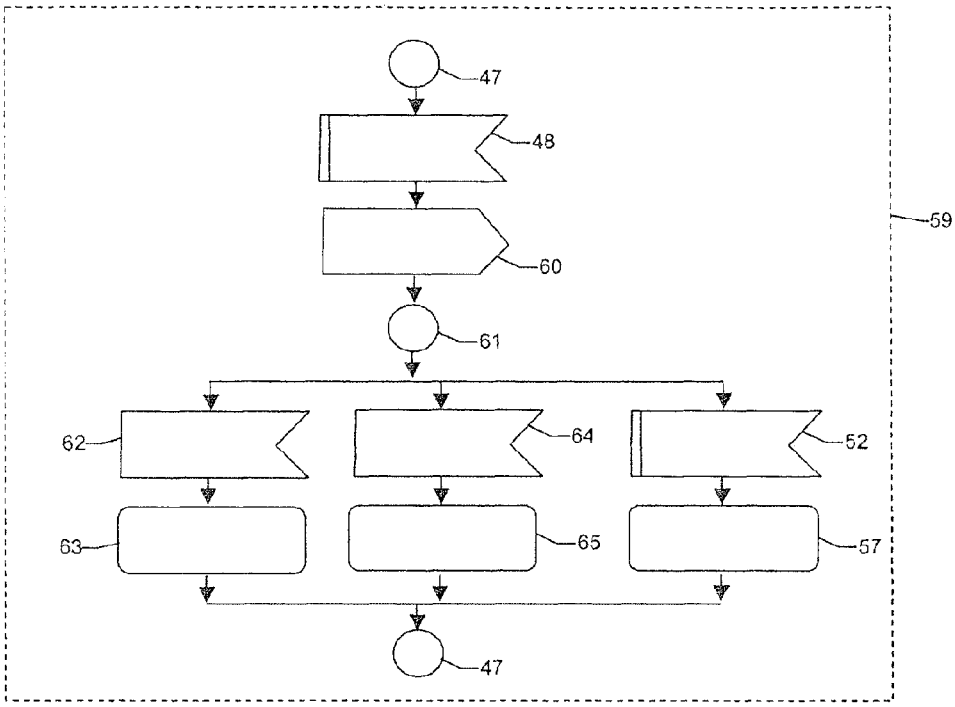
FIG. 10 is a block diagram of an identification and association to the local network carried out by a local device.

In other cases again, it is the local device 17 that starts a procedure 59 of identification and association to the wireless radio network 16 of the vehicle (FIG. 10), for example to request access to the radio network and to the information services of the convoy.

The present invention also allows to discriminate in cases where the acceleration profiles are not adequately decisive in associating the devices to the same transport vehicle. In fact forms or temporal evolutions of acceleration exist, the comparison of which gives different probabilities of identifying the transport of different devices by the same vehicle, and therefore temporal moments more or less adequate in which to measure the similarity between acceleration profiles. For example, in cases where the acceleration is zero, the devices could all be stationary, for example in a station, and under the same radio cover, but belonging to different transport vehicles.

These particular motion conditions can for example be detected from the information of instantaneous speed of the means in movement. This information can be made available to the supervisor 10:

by communication with the vehicle control system (for example for a railway convoy);

by tracking software of the temporal profile of the acceleration (integration).

The combination of an element that starts the identification request, that is, the supervisor 10 or the local device 17, and particular conditions of motion, such as constant speed, zero speed, slowly variable speed, and application scenario, defines the detailed application logic of the procedures carried out both by the supervisor 10 and by the local devices 17.

In the railway field for example, in the case of a convoy that is stationary in the station, and of a request for identification from a terminal of a passenger for access to the wireless radio network 16 of the convoy, the supervisor 10, which generally does not have a significant acceleration profile, could decide to:

not enable access to devices not previously identified;

continue to enable access to devices previously identified.

In this case the present invention can manage the stand-by condition or retry the identification request by the passenger's terminal.

Conversely, in the case of a convoy in motion at almost constant speed and with the identification procedure having been initiated by the supervisor 10, one of the following strategies can for example be adopted:

the supervisor 10 awaits a greater acceleration gradient before initiating the identification procedure;

since the convoy is already in motion, and in the hypothesis of having a list, already populated, of devices identified, the identification procedure is started and any errors due to insignificant acceleration profiles are compensated with the identification information possessed;

the identification procedure is activated, first increasing the sensitivity of the system, if possible, in terms of characteristics of resolution and/or sampling of the accelerometer 12, sending a specific command broadcast to all the devices to be interrogated.

Some forms of embodiment of the present invention provide the possibility of temporary coexistence of several supervisors 10, moved simultaneously together with a certain number of vehicles transported. This scenario is useful, for example, in the railways when a single convoy is made up starting from two trains equipped with the apparatus 100 according to the present invention.

Before the convoy is made up, the local devices 17 of a train are identified by the sole supervisor 10 relating to said train as discussed above.

After the convoy has been made up in the station, the two supervisors 10 will identify each other using a specific communication unit 130 between supervisors 10: they will inform each other about the list of local devices 17 currently managed by each supervisor 10 by means of a communication path 160 for the exchange of data and commands 150 between supervisors and/or with the vehicle control system (FIG. 1A). Each supervisor 10 will continue to manage its own list of devices while a suitable routing protocol will manage the communication between devices pertaining to different supervisors and between supervisors.

Example

Sizing in the Railway Field

In order to size and certify the use of the present invention in different fields, a verification must be made regarding the capacity of the supervisor 10 and the local device 17 to adequately sample the acceleration of the device and the vehicle, and regarding the capacity of the supervisor 10 to be able to compare the acceleration profiles relating to significant moments in the evolution of the movement over time.

For example, in the railway field it is useful to examine the commonly used curves of stress-speed relating to the most common locomotives and the temporal evolutions of speed typical of a railway convoy.

Figure 13A:
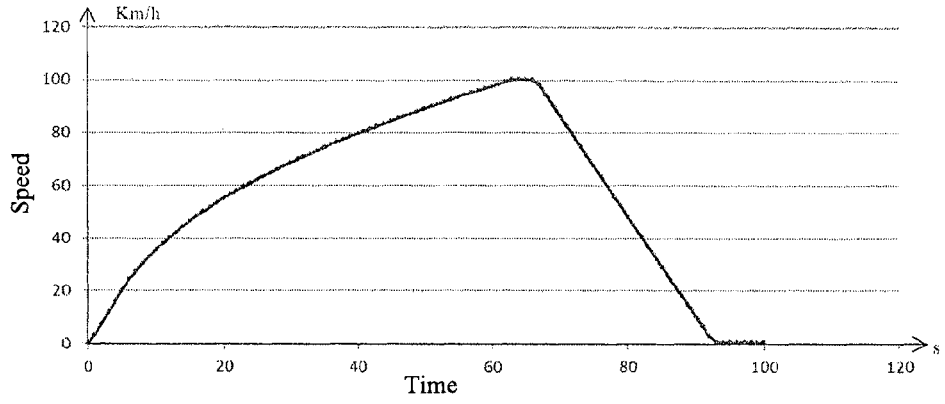
FIGS. 13A, 13B and 13C are examples of the trend of the motion characteristics for a train with electronic control of the speed, respectively graphs of speed, acceleration and variation in the acceleration.
Figure 13B:
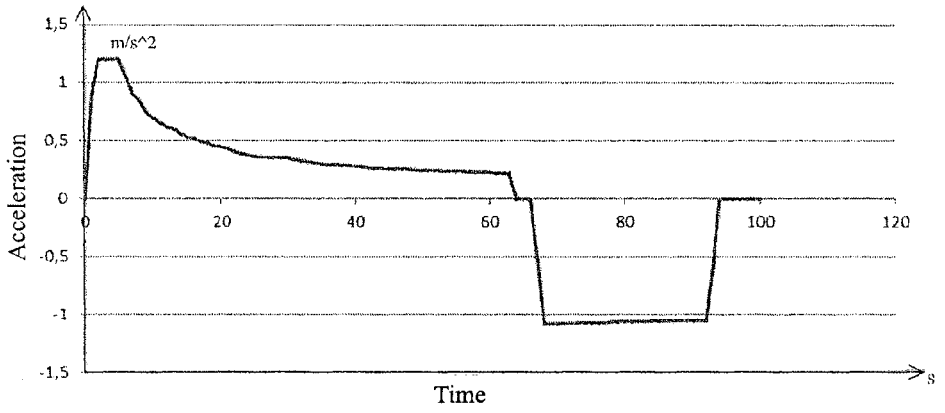
Figure 13C:
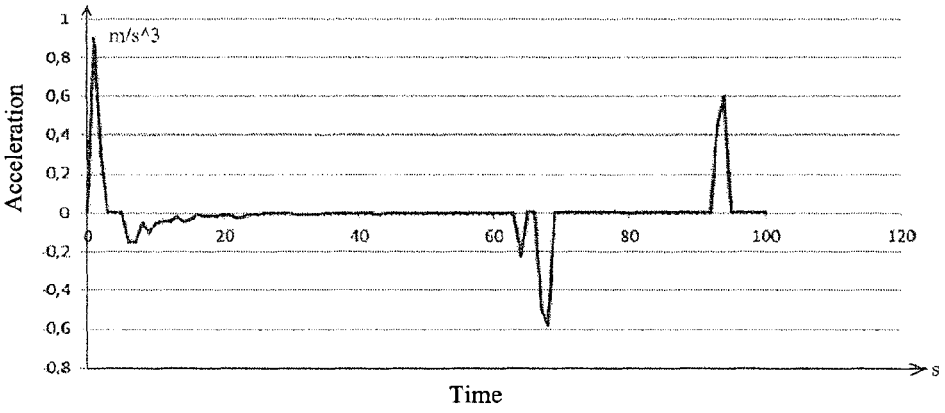

For example, from the common stress curves of locomotives it is verified that the trend of the speed has a parabolic evolution and, for locomotives without an electronic management of the power, the moments of greatest variation in the acceleration can be at the departure of the train or at the series/parallel switching of the feed circuits of the motors (FIGS. 13A, 13B and 13C). A comparison at the departure of the train by the supervisor 10 between the acceleration profiles of the devices therefore has a greater possibility of identifying the devices that are moved by the same train as the supervisor 10. A 10-hertz sampling in the first 5 seconds of acceleration is easily sufficient to characterize the trend of any railway material that respects the characteristics imposed by the safe acceleration regulations.

With reference to the curves in FIGS. 13A, 13B and 13C, also verifying the typical trend of the speed of a train with electronic management of the speed of the motors, which for example reaches the speed of 100 kilometers per hour in 65 seconds and which decelerates until it stops according to the safe acceleration regulations, it can be noted that the time intervals with greatest variation in acceleration are the departures and arrivals at a situation of standard speed. The present invention, applied in the railway field, therefore has, in moments of acceleration of the train at departure, on average 10 seconds in which the acceleration and its variation are at levels such as to allow the characterization of profiles with a similarity sufficient to allow the supervisor 10 to recognize the devices moving with the same train.

The invention claimed is:

1. Apparatus for the automatic identification of entities moved together by a transport vehicle, comprising:

at least a first element, or electronic supervisor device, constrained to the transport vehicle which moves said entities together, and configured to acquire in digital form a trend within a first time interval of acceleration, or first acceleration profile, to which said transport vehicle is subjected;

at least a second element, or local electronic device, constrained to each of said entities in motion, configured to acquire in digital form a trend within a second time interval of acceleration, or second acceleration profile, to which said entity in motion is subjected;

at least a wireless radio network-being provided for the communication between said first element, or electronic supervisor device, and each second element, or local electronic device;

each first element and second element comprising an electronic module which includes a radio communication electronic unit for the radio network, an electronic control unit and an electronic unit, or accelerometer, to detect acceleration to which the electronic module, and therefore the entity in motion or the transport vehicle to which said electronic module is associated, is subjected, wherein the first element is configured:

to detect, by means of the electronic unit or accelerometer at least a significant acceleration event to which the entities moved and/or the transport vehicle are locally subjected, in which both the starting instant of the first time interval and the starting instant of the second time interval correspond to the beginning of said significant acceleration event;

to carry out, by means of the electronic control unit, a crossed correlation operation of the first acceleration profile and the second acceleration profile to verify if any entity present in the vicinity corresponds to one of the entities currently being moved by said transport vehicle, wherein the electronic control unit is configured to perform the crossed correlation operation providing:

to compare the first acceleration profile with one or more other second acceleration profiles, if in the comparison one part of the first time interval and of the second time interval is identified in which the first acceleration profile and the second acceleration profile are more similar, to automatically identify the corresponding entities as moved by said transport vehicle, discriminating from other entities present in the vicinity, either in motion or not.

2. Apparatus as in claim 1, wherein the second element or local electronic device is associated to a code acquisition unit for the univocal identification of the specific entity in movement to which the determinate second element or local electronic device is associated.

3. Apparatus as in claim 1, wherein the second element or local electronic device is a pre-existing electronic terminal provided with calculation and connection capacity, which comprises a control unit, an integrated accelerometer and a wireless connectivity interface, configured to carry out an applicative software made for the specific terminal that obtains the necessary procedures and processes.

4. Apparatus as in claim 1, wherein both the first element and each second element are configured to carry out an acceleration profile detection procedure which includes a stand-by state, awaiting the acceleration sampling start event, a sampling and acquisition of the acceleration by the electronic unit or accelerometer, to detect the acceleration, an updating of the acceleration profile and again a stand-by state awaiting the acceleration sampling start event.

5. Apparatus as in claim 1, wherein the first element is configured to carry out an identification procedure of similar acceleration profiles which includes a stand-by state, awaiting a verification start event, a subsequent verification start event, the sending of a radio message to request a profile to at least a second element and reception of a radio message which contains the profile from the second element, or an error or timeout event, subsequent to the reception of the radio message, a similarity test being provided of the acceleration profiles associated to the first element and to the second element.

6. Apparatus as in claim 1, wherein each second element is configured to carry out an identification and association request procedure to the radio network which provides an initial stand-by state, awaiting a verification start event, a subsequent verification start event, the sending to the first element of a request message for association to the radio network, in which, depending on the reply message from the first element, at least an association to the radio network, or disassociation therefrom, is provided.

7. Apparatus as in claim 1, wherein each control unit is configured for a transmission/reception of data and/or commands toward the accelerometer and a transmission/reception of data and/or commands with the radio network by means of the radio communication unit.

8. Apparatus as in claim 1, wherein the wireless radio network of the vehicle is configured to put at least any second element in communication with the first element and is provided with a mechanism for the distribution of information from the first element to all the second elements of the wireless radio network, or to a subset of the second elements selected on the basis of the information received by the second elements.

9. Apparatus as in claim 1, wherein the control unit is configured to automatically detect significant acceleration events to start the identification, in the movement of the entities, of an accelerated motion similar to that of the transport vehicle and to cause a verification start event, said significant events being selected on the basis of an acceleration threshold, detected autonomously at regular intervals, or set as gradient of the acceleration detected.

10. Apparatus as in claim 1, wherein the control unit of the first element is configured to analyze the acceleration profile received by the second elements which provides to identify a possible time interval relating to the period during which the acceleration profile signal received by the first element has different characteristics from the one detected by the first element, and to use said time interval for the serialization of the entities moved together or the identification of anomalies, and a further time interval relating to the period in which the two acceleration profiles under comparison have a determinate degree of similarity, in which a verification and identification of similarity is carried out on said further time interval.

11. Apparatus as in claim 1, comprising:

a plurality of first elements simultaneously moved together with a determinate number of entities, each of said first elements being equipped with its own communication unit dedicated to communication between said first elements, each of said first elements providing a communication path for the reciprocal exchange of data and commands between said first elements and/or with a vehicle control system, to reciprocally supply at least information relating to a list of second elements managed by each first element.

12. Method for the automatic identification of entities moved together by a transport vehicle which comprises:

constraining at least a first element or electronic supervisor device to the transport vehicle which moves said entities together;

constraining at least a second element or electronic local device to each of said entities in motion;

acquiring in digital form, by means of the first element or electronic supervisor device, a trend in a first time interval of acceleration, or first acceleration profile, to which said transport vehicle is subjected;

acquiring in digital form, by means of the second element or local electronic device, a trend in a second time interval of acceleration, or second acceleration profile, to which at least one of said entities in motion is subjected;

putting said first element or electronic supervisor device in communication with each second element or local electronic device, via wireless radio network;

detecting at least a significant acceleration event to which the moved entities and/or the transport vehicle are subjected locally, in which both the start instant of the first time interval and also the start instant of the second time interval correspond to the start of said significant acceleration event;

carrying out a crossed correlation operation of the first acceleration profile and the second acceleration profile to verify if any entity present in the vicinity corresponds to one of the entities currently being moved by said transport vehicle, wherein said crossed correlation operation comprises:

comparing the first acceleration profile with one or more further second acceleration profiles, if in the comparison one part of the first time interval and of the second time interval is identified in which the first acceleration profile and the second acceleration profile are more similar, automatically identifying the corresponding entities moved by said transport vehicle, discriminating from other entities present in the vicinity, either in motion or not.

13. Method as in claim 12, comprising:

executing an acceleration profile detection procedure both with the first element and also with each second element which provides a stand-by state, awaiting the acceleration sampling start event, the subsequent sampling and acquisition of the acceleration, an updating of the acceleration profile and again a stand-by state, awaiting the acceleration sampling start event.

14. Method as in claim 12, comprising:

executing an identification procedure of similar acceleration profiles which includes a stand-by state, awaiting a verification start event, a subsequent sending of a radio message to request a profile to a second element, and reception of a radio message which contains the profile from the second element, or an error or timeout event, subsequent to the reception of the radio message a similarity test being carried out of the acceleration profiles associated to the first element and to the second element.

15. Method as in claim 14, wherein on the basis of the outcome of the similarity test, the association of the second element to the radio network of the vehicle is carried out if the profiles are similar, or the disassociation of the second element from the radio network of the vehicle.

16. Method as in claim 12, comprising:

executing an identification and association request procedure for the radio network which provides an initial stand-by state, awaiting a verification start event, a subsequent verification start event, the sending to the first element of a request message for association to the radio network, in which, depending on the reply message from the first element, at least an association to the radio network, or disassociation therefrom, is provided.

17. Method as in claim 12, comprising:

automatically detecting, by means of the first element and/or the second element, significant acceleration events to start the identification, in the movement of the entities, of an accelerated motion similar to that of the transport vehicle and to cause a verification start event, said significant events being selected on the basis of an acceleration threshold, detected autonomously at regular intervals, or set as gradient of the acceleration detected.

18. Method as in claim 12, comprising:

determining, by means of the first element, an analysis of the acceleration profile received from the second elements, which provides to identify a possible first time interval relating to the period during which the acceleration profile signal received by the first element has different characteristics from the one detected by the first element and which is used for the serialization of the entities moved together or the identification of anomalies, and a further time interval relating to the period in which the two acceleration profiles under comparison have a determinate degree of similarity, in which a verification and identification of similarity is carried out on said further time interval.

* * * * *